United States Patent [19]

Frank

[11] Patent Number: 4,864,662

[45] Date of Patent: Sep. 12, 1989

[54] ADJUSTABLE HEADGEAR

[76] Inventor: Joseph Frank, 553 Enniskillen Avenue, Winnipeg, Manitoba, Canada, R2V 0J5

[21] Appl. No.: 36,878

[22] Filed: Apr. 9, 1987

[30] Foreign Application Priority Data

Jan. 13, 1987 [CA] Canada ..... 527214

[51] Int. Cl.[4] ..... A42B 1/22

[52] U.S. Cl. ..... 2/183; 2/197

[58] Field of Search ..... 2/197, 175, 200, 183, 2/195, 198, 182.6

[56] References Cited

U.S. PATENT DOCUMENTS

| | | | |
|---|---|---|---|
| Re. 17,064 | 8/1928 | Fischer | 2/197 |
| 1,243,567 | 10/1917 | Spindler | 2/197 |
| 1,333,708 | 3/1920 | Fischer | 2/197 |
| 1,652,145 | 12/1927 | Lipschutz | 2/197 |
| 2,106,570 | 1/1938 | Lipton | 2/197 |
| 2,156,251 | 4/1939 | Carlson | 2/197 |
| 2,447,850 | 8/1948 | Feldman | 2/197 |
| 2,698,945 | 1/1955 | Hamilton | 2/197 |
| 3,714,670 | 2/1973 | Finsilver et al. | 2/197 |
| 3,766,565 | 10/1973 | Cozzens | 2/200 |
| 3,780,382 | 12/1973 | Boden | 2/182 G |
| 3,945,050 | 3/1976 | Bohash | 2/197 |
| 4,023,212 | 5/1977 | Huffman | 2/197 |
| 4,101,981 | 7/1978 | Boden | 2/182.6 |
| 4,539,715 | 9/1985 | Clement | 2/420 |

FOREIGN PATENT DOCUMENTS

| | | | |
|---|---|---|---|
| 1172804 | 8/1984 | Canada | 2/197 |

*Primary Examiner*—Peter Nerbun

*Attorney, Agent, or Firm*—McFadden, Fincham, Marcus & Allen

[57] ABSTRACT

The invention relates to adjustable headgear having a crown adapted to receive the head of the wearer, a slit extends inwardly and upwardly from the edge of the headgear into the crown side, which provides sufficient movement to allow for wide size adjustment. The crown is completed to form a head encircling enclosure by overlapping slit edges, or a separate cover to fill the slit. The slit edges are held in definite relationship to each other. The slit width is maintained in relative position by adjustable securing means mounted on either side of the slit, or by releasable adjustable securing means mounted on an exterior cover attached to the crown. The edges of the slit are maintained in alignment by separate guide means mounted on either side of the slit, or by the previously mentioned releasable adjustable securing means mounted on an exterior cover attached to the crown. The slit is covered by fabric formed either by the edges of the slit itself, a flap or an internal panel. When the guide means are part of the brim of a hat they also form a continuation and extension of the brim. Previous attempts to design a one-size-fits-all headgear were unable to provide a snug fitting brimmed hat with a continuous brim. The whole arrangement permits an adjustable hat without significant, visible or substantial deformation of the headgear.

14 Claims, 4 Drawing Sheets

ADJUSTABLE HEADGEAR

This invention relates to adjustable headgear, especially brimmed adjustable headgear.

"One-size-fits-all(-adults)" adjustable headgear has long been desired by manufacturers of headgear, including hats, caps, and other headgear. Attempts to produce this have not been universally successful, and when adopted were limited in application, or had other drawbacks. As a result, headgear is often produced in a range of sizes, which while costlier to make, satisfies the wearer.

There are four basic adjustable headgear solutions indicated in the prior art of which applicant is aware. The first is an outer unadjustable shell, suspended on an inner adjustable arrangement. The second is to provide an adjustable strap to vary the base periphery of the headgear to fit the wearer's head. The third is to provide deformable headgear which expands to fit the wearer's head. Hybrids between the first and second solutions are known. A fourth possibility comprises two adjustably engaging overlapping shells. Adjustable brimmed hats are uncommon in the prior art.

DESCRIPTION OF THE PRIOR ART

The first general approach is to provide an outer unadjustable shell suspended on adjustable means, which grip or rest upon the wearer's head. Two common forms of this are military helmets and construction hard hats, where the headgear is suspended upon an adjustable headband or sweatband, usually comprising a single strip or strap, having two ends, which may be shortened and lengthened as required and secured at this length by any suitable securing means. U.S. Pat. No. 3,780,382, issued Dec. 25, 1973 to Boden, teaches a cap having outer and inner shells, the inner shell contacting the head at two contact pads and a rear notch across which an adjustable strap is secured by a fastener, this arrangement is indicated as suitable for a brimmed hat, presumably by making the outer shell of that form, but there is no specific teaching on this point. A brimmed hat is also taught, where an unadjustable shell is mounted on a resilient frame having contact pads to fit the head. This patent is directed to ventilated headgear, but also includes some adjustment features. U.S. Pat. No. 4,101,981, issued July 25, 1978 to Boden, teaches inter alia, a shell brimmed hat mounted upon four contact pads, which is not adjustable. U.S. Pat. No. 4,274,157, issued June 23, 1981 to Boden, teaches a non adjustable shell cap, which could be a non adjustable brimmed shell hat although not so indicated, having an adjustable inner partial sweatband attached at a number of contact points to spacer elements on the shell by VELCRO TM fastener arrangements. Optionally other contact pads may be attached to the shell. British Pat. No. 1,442,333, published July 14, 1976 to Lamb, teaches a brimmed hat mounted upon a elastic stretchable headband or sweatband, which enables the number of popular hat sizes stocked to be reduced by half.

The second approach is to provide an adjustable strap immediately adjacent the interior or exterior base periphery of the crown of the cap or brimmed hat, which may run entirely around the periphery or a part thereof. Common examples are the military peaked forage cap of World War I, often adjusted by an exterior strap across the forehead, and the modern baseball cap adjusted by an interior but exposed strap in the rear. U.S. Pat. No. 1,333,708, issued Mar. 16, 1920 to Fischer, teaches a cap adjustable by a buckled strap, there is a slit on either side of the peak or visor, formed by leaving a vertical seam unstitched for a short portion of its length, such that the peak and front may be moved in and out with respect to the back of the cap, to provide a limited size adjustment. The strap is arranged to cover the slit when worn. A version without peak or visor is also described, of similar construction, fastened at the back. A sweat-band is indicated in preferable form attached to the inside of the cap, which effectively expands and contracts with adjustment without slack or stretch. U.S.Re.P. 17,064, issued Aug. 7, 1928 to Fischer, teaches a brimmed hat having at least one set of expandable pleats extending from the crown to the brim edge. These pleats may be adjusted either by a hat encircling band or strap sewn or otherwise fixed to the hat at the top of the brim, or by a strap which just encircles the pleats, the ends in both cases are adjustably secured together. An ornamental piece may be attached to the hat to cover the pleats. The same system may be used for a similar cap. It is preferred to provide an internal sweatband, either overlapping or one end sliding in and out of the other. U.S. Pat. No. 2,447,850, issued Aug. 24, 1948, to Feldman, teaches a peaked cap, adjustable by a strap around the head having adjustable securing means (stud and socket), which is concealed in a channel at the rear of the cap. Two open arched notches on either side allow for expansion or contraction. U.S. Pat. No. 4,023,212, issued May 17, 1977 to Huffman, teaches a visored cap with detachable crown the visor can be secured adjustably in one case by a strap passing around the back of the head, which then is secured within the rear portion of the crown by a VELCRO TM overlap. In the other case two straps are adjustably secured within the rear portion of the crown by VELCRO TM overlap. The front portion of the crown is detachably secured to the visor. Two arched notches to allow for expansion and contraction are formed laterally in the crown. U.S. Pat. No. 3,766,565, issued Oct. 23, 1973 to Cozzens, teaches a visored cap adjustable by a strap at the rear, having an arched notch to allow for adjustment. U.S. Pat. No. 4,101,981, issued July 25, 1978 to Boden, mentioned above, teaches a similar arrangement, with two or four contact pads within the cap, and in one case instead of a notch a slit, the edges of which may overlap slightly, or form a notch. U.S. Pat. No. 3,714,670, issued Feb. 6, 1973 to Pollack et al, teaches a flexible hair cover, which has a headband having elastic and nonelastic segments, the non elastic segment being adjustably secured by VELCRO TM. U.S. Pat. No. 3,945,050, issued Mar. 23, 1976 to Bohash, U.S. Pat. No. 4,021,859, issued May 10, 1977 to Burke, and U.S. Pat. No. 4,317,238, issued Mar. 2, 1982 to Amin, all teach adjustable cap kits. Bohash teaches a cap adjustable by a hook and slot arrangement. Amin teaches a cap with of four standard components, three forming the hat or sweatband, which can be made into a series of sizes, it does not appear that adjustment after assembly is contemplated. Burke, teaches an open ended band which when placed around the head and joined forms a head covering.

The third general approach is to provide deformable headgear. U.S. Pat. No. 2,214,995, issued Sept. 17, 1940 to Dorsey, teaches a brimmed hat having two vertical channels of resilient material, lateral to the crown. When the hat is forced onto a head, too large for the original hat, the diameter of the crown enlarges resiliently. U.S. Pat. No. 2,698,945, issued Jan. 11, 1955, to Hamilton, teaches a skull cap having a rear elastic panel. When placed upon a head larger than the unexpanded cap, the panel stretches to fit.

A fourth approach is that indicated in U.S. Pat. No. 4,539,715 and Canadian Patent 1,183,302, where a hockey helmet has multiple overlapping parts, usually a forward shell which slides engageably into a rear shell, in this case the interior is padded and the back of the head is fitted into the rear shell, then the forward shell is fitted to the wearer's forehead, the shells are then engaged.

The above mentioned prior art has a deficiency in that it provides no truly adjustable headgear, which have a snug fit over a wide range of sizes, in the absence of substantial deformation, so that the headgear maintains essentially the same shape, and the elements of the headgear maintain essentially the same relative positions. The most common presently available adjustable headgear is of the baseball cap type, which while suitable for summer use, is not suitable for wear in winter or rain. Further the above mentioned prior art provides no truly adjustable brimmed hats, which have a snug fit over a wide range of sizes, and a relatively stiff continuous brim.

It is an object of the invention to provide adjustable headgear, which has a snug fit over a wide range of sizes, without substantial deformation of the headgear shape, and preferably with minimal or zero shape deformation. It is a further object to provide an adjustable brimmed hat which has an effectively continuous brim. It is a further object to provide headgear which has not only a snug fit, but which overlaps such that openings may be eliminated, other than those customary for ventilation when desired, for example mesh panels in the headgear.

DESCRIPTION OF THE INVENTION

In adjustable headgear having a crown member adapted to receive the head of the wearer, said crown member including a top portion and a side portion, the improvement comprising in combination a slit having two free edges extending inwardly and upwardly from the edge of the headgear into the side portion of the crown, said slit having sufficient length to provide a substantial desired adjustment, across said slit and at least one of (a) a separate cover member attached to said crown member, adapted to enclose a space between said free edges of said slit to complete said crown member and to provide a head encircling crown enclosure independent of size, adjustable securing means to secure said separate cover member releasably to at least one side of said slit and maintain said slit edges in relative position; and (b) cooperating guide means mounted upon one side of the slit and slidably received upon the other side of the slit and adjustable securing means to secure said slit edges in relative position; whereby said slit edges are maintained in substantial alignment. The separate cover member mounting the means to adjustably secure the slit edges in relative position and the cooperating guide means to maintain the slit edges in substantial alignment can be used interchangeably in the sense that both hold the headgear in more or less the same shape and the parts in the same relationship. The slit having sufficient length to provide a substantial desired adjustment, would generally be expected to be of sufficient length to reach upwards to a level roughly equal to the top of the side of a wearer's head, this would be highly variable and depend on the age and headsize of the wearer, the way that the headgear was worn, the configuration of the head of the wearer, and the style of the headgear.

Optionally a foldable neck and ear protector can be supplied extending around the rear of the headgear, this is attached along the base of the crown, and does not extend across the slit.

The separate cover member, which has adjustable securing means to secure said separate cover member releasably to at least one side of said slit, may be attached at the top of the slit and fold down and be adjustably secured at both sides of the slit, alternatively it may be attached at one side of the slit and adjustably secured at the other, optionally it may be attached at one side and the top and adjustably secured on the other side of the slit. This cover may be a flap adjustably secured by a VELCRO TM strip mounted upon the flap which engage a VELCRO TM strip mounted adjacent the slit edges, this approach may be used when one or both sides of the flap are adjustably secured to the sides of the slit.

In a preferred form the crown member has an attached circumjacent brim. The brim edges, are joined by a means providing an extension of the brim across the slit. It is advantageous to provide a brim connection across the slit so that the brim is continuous and its ends adjacent the slit do not flop around with respect to each other, this can be provided by the cooperating guide means, when mounted in the brim, or by an adjustable strip forming an extension of the brim across the slit. It may also be provided by means holding the brim edges together; when the brim edges overlap a clip or similar means may be used.

The cooperating guide means to maintain the slit edges in substantial alignment comprises a guide mounted upon one side of the slit, and received in a receptacle on the other side of the slit, either in the crown or the brim of the hat. The guide can be mounted in the crown on one side of said slit and received in the crown on the other side of the slit. The guide can also be mounted on the brim on one side of the slit and received in the brim on the other side of the slit, in which case the guide means form a continuation of the brim across said slit. When the guide means are in the crown, and a brim is present it is convenient to allow the brim edges to overlap. In such case the slit edges may also overlap. The cooperating guide means may be slidably received in channels or receptacles specially provided in the brim or crown fabric. Alternatively they may be received between fabric layers in crown and brim, as the crown and brim often are formed of two, or more, fabric layers, these are usually stitched together to form a seam, but a gap to form a pocket may left at or near the slit edge to form a receptacle, pocket or channel to slidably receive the guide means, this is particularly suitable when the guide means are provided in the brim.

In another aspect the headgear may comprise additionally to the heretofore described slit a separate cover member attached to said crown member, adapted to enclose a space between said free edges of said slit to complete said crown member and to provide a head encircling crown enclosure independent of size, cooperating guide means mounted upon one side of the slit and slidably received upon the other side of the slit and adjustable securing means to secure said slit edges in relative position; whereby said slit edges are maintained in substantial alignment. The separate cover member may mount releasable adjustable securing means, as earlier indicated, or these means may be separate. The adjustable securing means any means attached to both sides of the slit, such as strap means, while the cover member may be an internal panel, attached to the crown, which may be received in two pockets formed in the crown on both edges of the slit. The internal panel can be swivelably attached to the crown, for example by a dome fastener. This can be varied the panel could be attached at one side or be an internal flap received in a pocket on one side of the slit.

In a further aspect adjustable headgear is provided having a crown member adapted to receive the head of the wearer, said crown member including a top portion and a side portion the improvement comprising in combination a slit having two free edges extending inwardly and upwardly from the edge of the headgear into the side portion of the crown, the slit having sufficient length to provide a substantial desired adjustment, a separate cover member attached to said crown member, adapted to enclose a space between said free edges of said slit to complete said crown member and to provide a head encircling crown enclosure independent of size, adjustable securing means to secure said separate cover member releasably to at least one side of said slit and adjustable securing means to secure said slit edges in relative position.

The adjustable securing means may be any known in the art, exemplified but not limited to straps with buckles, buckles mounted upon zippers, straps with interengaging portions, whether VELCRO TM or connector elements or snap fasteners, hook and slot arrangements, strap and fastener clamp, buttons and button holes and the like.

Although described with respect to one slit, two or more can be present for convenience and for appearance.

DESCRIPTION OF PREFERRED EMBODIMENTS

Figure 1A:
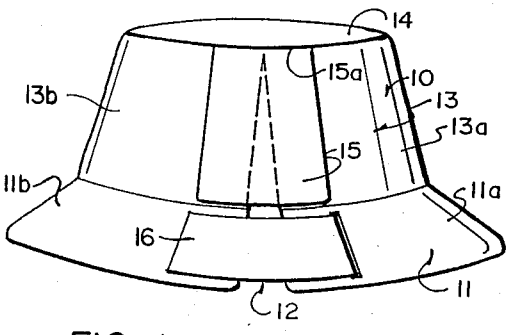
Figure 2B:
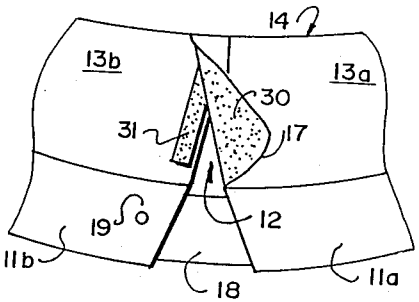
Figure 2A:
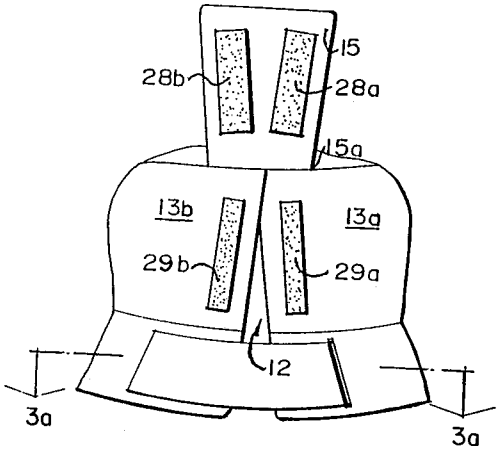
Figure 4A:
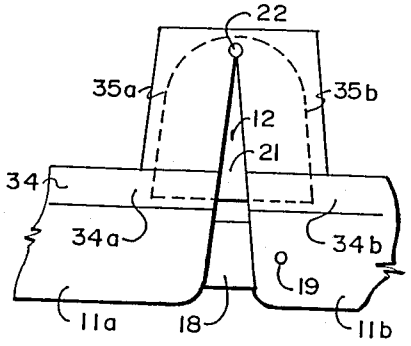
Figure 4B:
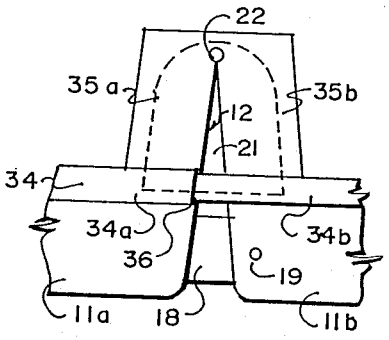
Figure 5:
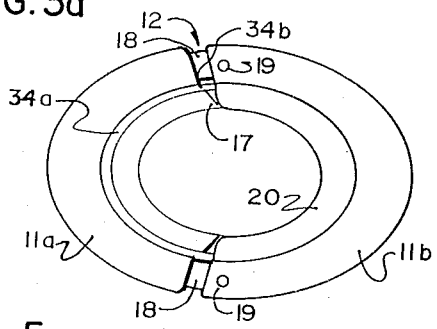

Preferred embodiments are indicated in the drawings where:

FIGS. 1*a* to 1*d* illustrate exterior views of headgear according to the invention;

FIGS. 2*a* and 2*b* illustrate views of adjustable securing means according to the invention;

FIGS. 3*a* to 3*d* illustrate brim arrangements according to the invention;

FIGS. 4*a* and 4*b* illustrate interior views of headgear according to the invention;

FIG. 5 illustrates a variation of headgear according to the invention;

FIGS. 6*a* to 6*d* illustrate interior guide arrangements according to the invention.

Figure 1B:
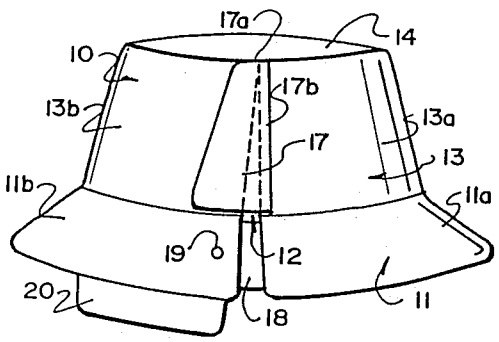
Figure 1C:
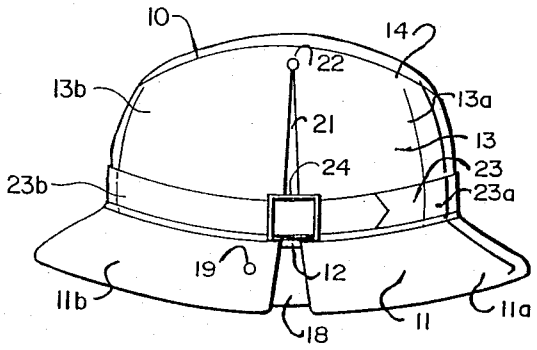
Figure 1D:
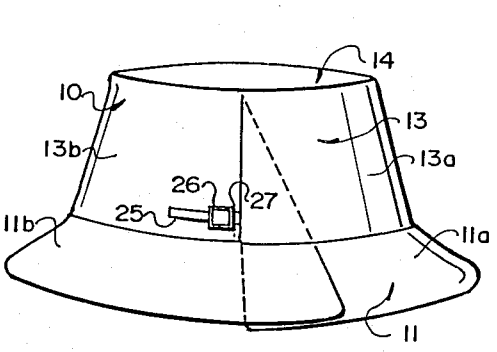
Figure 3B:
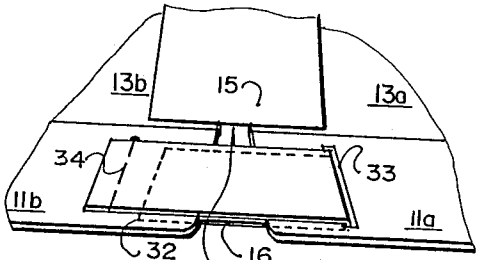
Figure 3A:
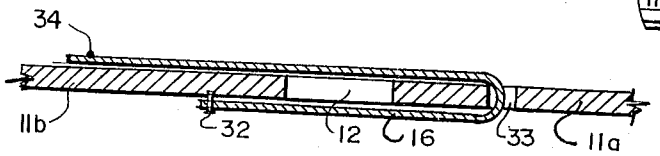
Figure 3C:
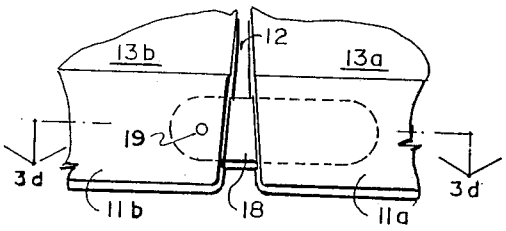
Figure 3D:
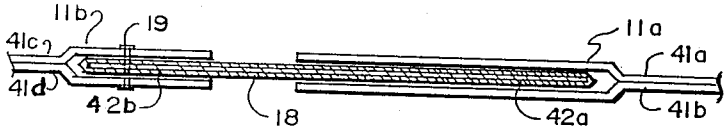
Figure 6B:
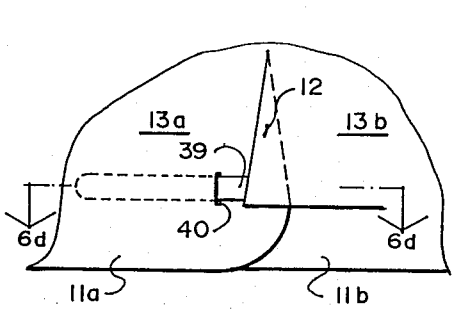
Figure 6A:
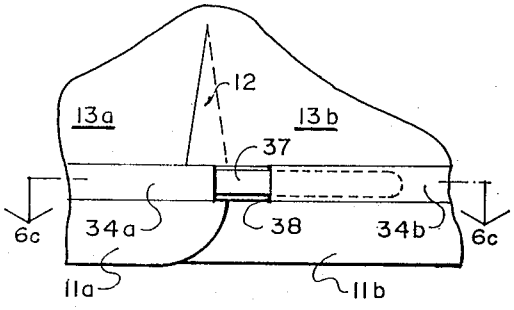
Figure 6C:
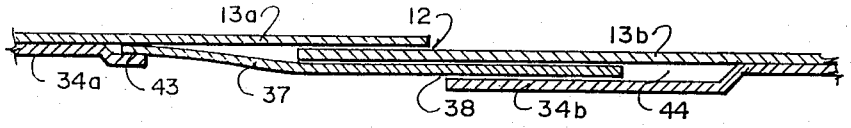
Figure 6D:
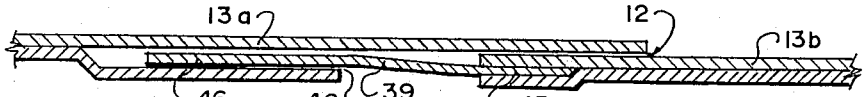

The general description of the invention is now expanded by reference to the drawings, which illustrate preferred embodiments of the invention. In the figures, the hats consist of a crown member 10 having a circumjacent brim member 11, the crown portion 10 has a top portion 14 and side portion 13, in the illustrated embodiments, two lateral slits 12 extend down the side portion 13 of the crown from the top portion 14. As shown in the embodiments, this top may be a top panel which does not contact the brim, or a center panel which extends from front to rear of the crown, although it is not limited to these possibilities. The slits 12 as illustrated divide the crown side portion 13, and brim portion 11 into front brim 11*a* and side 13*a*, and rear brim 11*b* and side 13*b*. In FIG. 1*a* slit 12 is covered by flap 15, and the brims 11*a*, and 11*b* held together by strip 16, (mounted as later indicated), which covers slit 12 in the brim, the edges of slit 12 are indicated by broken lines. Flap 15 is attached to the crown along edge 15*a*. In FIG. 1*b* slit 12 is covered by flap 17, which is attached to the crown along edges 17*a*, and 17*b*, again the slit edges are indicated by broken lines. The slit 12 in the brim 11 is covered by stiffener guide 18, which is formed of fabric covered plastic and mounted in rear brim 11*b*, and received in front brim 11*a*, (as later indicated). It is attached to rear brim 11*b*, by rivet 19. The stiffener guide is preferably rounded at the ends for ease of movement, and to prevent catching. FIG. 1*b* has additionally a neck and ear protector 20, which can be folded into the interior of crown 10, when not in use, this protector is attached to the base of the crown portion 10, (as later indicated). FIG. 1*c* shows hats having similar features to those of FIG. 1*b*. Instead of flap 17 covering the slit 12, it is filled by swivel stiffener panel 21, which is snapped into dome fastener 22, this panel extends into pockets (as later indicated) in crown sides 13*a*, 13*b*. Hat trim, braid, or band 23 is used to adjust hat size, by plastic buckle 24, attached to front band 23*a*, through which rear band 23*b* passes. This band may fill a gap between panel 21, and guide 18. FIG. 1*d* shows a hat, where rear side 13*b*, moves inside front side 13*a*, and rear brim 11*b*, moves over front brim 11*a*, the front edge of rear crown side 13*b* is indicated by a broken line, as is the rear edge of front brim 11*a*. Front side 13*a* is attached to connector 27, itself attached to plastic buckle 26, which adjustably rides on open ended zipper 25, attached to rear side 13*b*. FIG. 2*a* shows securing means employed in the hat of FIG. 1*a*. Two VELCRO TM strips 28*a* and 28*b*, are attached substantially parallel to the edges of flap 15 upon its interior surface, two other VELCRO TM strips 29*a*, and 29*b* are attached substantially parallel to the edges of slit 12 on the exterior surfaces of sides 13*a* and 13*b*, respectively. When flap 15 is brought against side 13, strip 28*a* engages strip 29*a*, strip 28*b* engages strip 29*b* securing flap 15 to close slit 12. FIG. 2*b* shows the flap 17 of FIG. 1*b* folded back at an angle to reveal broad VELCRO TM strip 30 attached to the interior of flap 17 parallel to its rear edge, narrow VELCRO TM strip 31 is attached to the exterior of rear side 13*b* parallel to the edge of slit 12. On closing flap 17, strip 30 engages strip 31 thus securing flap 17 to close slit 12. FIGS. 3*a* and 3*b* illustrate the brim continuation of FIGS. 1*a* and 2*a*, FIG. 3*a* shows the cross-section along line 3*a*—3*a* of FIG. 2*a*, here the strip 16 is attached to the undersurface of rear brim 11*b*, at 32, passes across slit 12, up through slot 33 in front brim 11*a*, back over slit 12, and is secured to upper surface of rear brim 11*b*, by pin 34, the broken line in FIG. 3*b* indicates the position of strip 16 underneath the brim. FIG. 3*c* shows the hat brim joining of FIG. 1*b* and 1*c*. The fabric covered stiffener guide 18 is secured to rear hat brim 11*b* by rivet 19, and is received in front hat brim 11*a*, the position of stiffener guide 18 is indicated by the broken line. FIG. 3*d* shows the brim arrangements of FIG. 3*c* in cross section indicated along line 3*d*—3*d* in FIG. 3*c*, stiffener guide 18 is mounted in rear brim 11*b* in pocket 42*b* formed between upper fabric layer 41*c* and lower fabric layer 41*d*, and secured by rivet 19 passing through the fabric layers 41*c*, 41*d*, and guide 18, which is slidably received by pocket 42*a* formed between upper fabric layer 41*a* and lower fabric layer 41*b* of front brim 11*a*. FIGS. 4*a* and 4*b* show two hat interiors using swivel panel stiffeners 21, the edges of the panel 21 are indicated by the broken lines, pockets in the interior of the crown of the front 35*a* and rear 35*b* of slit 12 receive the swivel panel stiffener, attached to dome fastener 22, sweatband 34 is broken into two sections in FIG. 4*a*, front 34*a*, rear 34*b*, the slit in the brim is closed by stiffener guide 18, attached by rivet 19. In FIG. 4*b*, the sweatband is adjustable, rear sweatband 34*b* extending forward through loop 36 into the space behind front sweatband 34*a* and in front of pocket 35*a* and crown side 11*a*. The inner surface of pockets 35*a*, and 35*b* may be formed by the hat lining which is attached to the crown fabric at the outer edges of the pockets 35*a* and 35*b*, or in the absence of a lining by attaching fabric panels to the crown fabric at the outer edges of the pockets. FIG. 5 shows the interior of the hat of FIG. 1*b*, when ear and neck protector 20 is folded inside crown portion 10, protector 20 is attached along an edge to the rear base edge of crown portion 10. Slit 12 is filled by stiffener guide 18, rear sweatband extension 34*b* and inside of flap 17. In the case of a hat incorporating an ear and neck protector it is preferred to set the slits forward, so as to provide protection to as much of the periphery of the wearer's head as possible, as is shown in FIG. 5. FIGS. 6*a* and 6*b* show the internal arrangements of the hat of FIG. 1*d*, a plastic guide 37 is mounted in front sweatband 34*a*, and is received in rear sweatband 34*b* in a channel (as indicated later) entered by slit 38 as indicated by the broken line outlining the position of guide 37. In FIG. 6*b* the sweatband has been removed to show plastic guide 39 mounted in rear crown fabric 13*b*, and received in front crown fabric 13*a*, in a channel (as indicated later) entered by slit 38 as indicated by the broken line outlining the position of guide 37. In FIG. 6*b* the sweatband has been removed to show plastic guide 39 mounted in rear crown fabric 13*b*, and received in front crown fabric 13*a*, in a channel (as indicated later) entered by slit 40, the broken line indicating the position of guide 39. In FIGS. 6*a* and 6*b* the rear edge of front crown side 13*a* are indicated by broken lines. FIG. 6*c* shows a cross section along line 6*c*—6*c* in FIG. 6*a*, omitting details shown in FIG. 6*b*, guide 37 passes between front crown side 13*a* where it is mounted in channel 43 between side 13*a* and sweatband 34*a* into slit 38 to be slidably received by channel 44 between rear side 13*b* and rear sweatband 34*b*. FIG. 6*d* shows a cross section along line 6*d*—6*d* in FIG. 6*b*, omitting details shown in FIG. 6*a*, guide 39 is mounted in between fabric layers of rear portion 13*b* in channel 45, and passes through slit 40 to be slidably received in channel 46 formed by fabric layers of front side 13*a*.

The headgear of the invention can be made of any suitable fabric, while the material may be fairly rigid, it may be quite soft or flexible. The invention is applicable to most styles of hat and headgear. Although the hats illustrated are intended to be of appealing style the hats are not restricted thereto, the particular style being insignificant. Although illustrated by brimmed hats which are especially preferred the invention is applicable to caps with and without peaks/visors.

Although this invention is described in terms of specific embodiments, it is not limited thereto, as would be understood by those skilled in the art, numerous variations are possible within the scope of the invention, without departing from the scope and nature thereof.

I claim:

1. In adjustable headgear having a crown member adapted to receive the head of the wearer, said crown member including a top portion and a side portion, an said crown member having an attached circumjacent brim, the improvement comprising in combination a slit having two free edges extending inwardly and upwardly from the edge of the headgear into the side portion of the crown, said slit having sufficient length to provide a substantial desired adjustment, a separate cover member attached to said crown member comprising an internal panel swivelably attached to the crown of said headgear, said internal panel being received in two pockets formed in the crown on both edges of the slit, said internal panel being adapted to enclose a space between said free edges of said slit to complete said crown member and to provide a head encircling crown enclosure independent of size, and cooperating guide means mounted upon one side of the slit in said brim and slidably received upon the other side of the slit in said brim and separate adjustable securing means to secure said slit edges in relative position; whereby said slit edges are maintained in substantial alignment and said cooperating guide means provides an extension of said brim across said slit.

2. The headgear of claim 1, wherein said internal panel is a stiffener panel.

3. In adjustable headgear having a crown member adapted to receive the head of the wearer, said crown member including a top portion and a side portion and having an attached circumjacent protruding brim, the improvement comprising in combination a slit having two free edges extending inwardly and upwardly from the edge of the headgear into the side portion of the crown, said slit having sufficient length to provide a substantial desired adjustment, cooperating guide means mounted on said brim on one side of said slit and received in the brim on the other side of the slit, and separate adjustable securing means to secure said slit edges in relative position; whereby said slit edges are maintained in substantial alignment and said cooperating guide means provides a protruding continuation of said circumjacent protruding brim across said slit, to provide said headgear with a head encircling protruding brim adjacent said crown.

4. The headgear of claim 3, additionally comprising a separate cover member attached to said crown member, adapted to enclose a space between said free edges of said slit to complete said crown member and to provide a head encircling crown member independent of size.

5. The headgear of claim 4, wherein said separate adjustable securing means to secure said slit edges in relative position, is mounted on both sides of the slit on the side portion of the crown member adjacent said circumjacent brim.

6. The headgear of claim 3, wherein said cooperating guide means is slidably received in a receptacle in the brim on the other side of the slit.

7. The headgear of claim 6, wherein said receptacle is a channel in the brim.

8. The headgear of claim 5, wherein said separate adjusting means comprises strips mounted on both sides of the slit, adjustably connected by buckle means.

9. In adjustable headgear having a crown member adapted to receive the head of the wearer, said crown member including a top portion and a side portion, and said crown member having an attached circumjacent protruding brim, the improvement comprising in combination a slit having two free edges extending inwardly and upwardly from the edge of the headgear into the side portion of the crown, said slit having sufficient length to provide a substantial desired adjustment, a separate cover member attached to said crown member comprising an internal panel attached in the crown of said headgear, adapted to enclose a space between said free edges of said slit to complete said crown member and to provide a head encircling crown enclosure independent of size, and cooperating guide means mounted upon one side of the slit in said brim and slidably received upon the other side of the slit in said brim and separate adjustable securing means to secure said slit edges in relative position; whereby said slit edges are maintained in substantial alignment and said cooperating guide means provides a protruding continuation of said circumjacent protruding brim across said slit, to provide said headgear with a head encircling protruding brim adjacent said crown.

10. The headgear of claim 9, wherein said internal panel is received in two pockets formed in the crown on both edges of the slit.

11. The headgear of claim 10, wherein said internal panel is a stiffener panel.

12. The headgear of claim 9, wherein said separate adjustable securing means to secure said slit edges in relative position, is mounted on both sides of the slit on the side portion of the crown member adjacent said circumjacent brim.

13. The headgear of claim 9, wherein said cooperating guide means is slidably received in a receptacle in the brim on the other side of the slit.

14. The headgear of claim 12, wherein said separate adjusting means comprises strips mounted on both sides of the slit, adjustable connected by buckle means.

* * * * *